United States Patent [19]

Lok

[11] Patent Number: 4,984,558

[45] Date of Patent: Jan. 15, 1991

[54] LARGE-BURNER STOVE WITH HIGH HEAT EXHAUST DUCTING

[76] Inventor: Yuk L. Lok, 33-39 73rd St. Jackson Heights, Queens, N.Y. 11372

[21] Appl. No.: 480,913

[22] Filed: Feb. 16, 1990

[51] Int. Cl.[5] ..... F24C 3/00

[52] U.S. Cl. ..... 126/39 R; 126/307 R; 126/297

[58] Field of Search ..... 126/39 R, 39 H, 39 K, 126/301, 302, 303, 299 R, 299 D, 299 F, 293, 297, 307 R

[56] References Cited

U.S. PATENT DOCUMENTS

| | | | |
|---|---|---|---|
| 38,776 | 6/1863 | Verbeck et al. | 126/297 |
| 847,378 | 3/1907 | Sloan | 126/293 |
| 4,406,396 | 9/1983 | Habegger | 126/293 |

FOREIGN PATENT DOCUMENTS

| | | | |
|---|---|---|---|
| 2475697 | 8/1981 | France | 126/39 H |
| 341555 | 1/1931 | United Kingdom | 126/39 K |

*Primary Examiner*—Carroll B. Dority
*Attorney, Agent, or Firm*—Leighton K. Chong

[57] ABSTRACT

A stove suitable for large-burner cooking generating a high heat exhaust has an enclosed stove casing with an upper cooking surface, a hollow interior, and a burner well recessed into the interior of the casing. A large burner is positioned in the burner well, and a cooking vessel can be placed over the well so as to close the burner flame off from the outside. The burner well preferably supports a wok or other rounded-bottom cooking vessel. The high heat exhaust from the burner is trapped in the well and entrained by natural convection into a duct member to a duct casing at a rear side of the stove. The duct casing has a double wall construction and baffles in its interior forming a labyrinthine channel for mixing cold air supplied through openings in the stove casing and the hot exhaust air from the large burner.

18 Claims, 3 Drawing Sheets

LARGE-BURNER STOVE WITH HIGH HEAT EXHAUST DUCTING

FIELD OF THE INVENTION

This invention generally relates to a stove for cooking, and particularly to one having a large burner generating high heat exhaust.

BACKGROUND ART

Industrial stoves, e.g. as used in restaurants and institutional kitchens, often have one or more large burner units that generate a high amount of heat and smoke that must be exhausted from the cooking area. Equipment typically used to handle large volumes of exhaust include large fans that pull heated and smoke-filled air from around the stove cooking area into a duct system that directs the high heat exhaust out through an exit vent or a chimney. In such conventional large-burner stoves, the burners provide their gas-fired flames at the stove surface under the pots, frying pans, and other cooking vessels. In the cooking of Oriental foods, a large-diameter wok is typically seated on a support or collar while a large burner provides an exposed flame often at full gas volume.

The exposed flames of large-burner stoves generate high amounts of heat that must be ducted forcefully away from the cook. Measures must be taken to handle the high heat of the exhaust. For example, the high heat exhaust must be ducted into a chimney lined with refractory material, or must be forcefully mixed with cool air to reduce its temperature to manageable levels. The required high-capacity fan and duct system is a large equipment that has a high cost and takes up a large volume of space. This requirement makes large-burner stoves costly, unsuitable and/or unsafe for common use in the home.

SUMMARY OF THE INVENTION

It is therefore a principal object of the invention to provide a large-burner stove that has a simple and inexpensive structure for handling high heat exhaust. In particular, it is desired to have a large-burner stove which is suitable for use in the home, and which does not require a high-capacity fan and duct system to handle the exhaust. It is a further object to provide means for moderating high heat exhaust from a large-burner stove using a natural convection draft without the necessity of using a duct fan.

In accordance with the present invention, a stove suitable for large-burner cooking generating a high heat exhaust comprises an enclosed stove casing having walls defining a horizontal upper surface used as a cooking surface and a hollow interior, a burner well extending into the interior of said stove casing and having an upper annular rim at said horizontal upper surface, said annular rim defining a support on which a cooking vessel is placed for cooking and being dimensioned such that the cooking vessel substantially closes off said well from exposure at said horizontal upper surface, a burner recessed at an interior position in said well in the interior of said casing which provides a flame to a bottom portion of the cooking vessel, and ducting means including a first duct member positioned at a rear portion of said stove casing remote from said burner well and a second duct member having an opening located adjacent said interior position of said well and another opening communicating into said first duct member for conveying high heat exhaust from said burner into said first duct member at said rear portion of said stove casing.

In accordance with another aspect of the invention, a stove suitable for large-burner cooking generating a high heat exhaust comprises an enclosed stove casing having walls defining a horizontal upper surface used as a cooking surface and a hollow interior, a burner well extending into the interior of said stove casing below an opening in the cooking surface over which a cooking vessel is placed, a burner in said well which provides a flame to a bottom portion of the cooking vessel, and ducting means including a first duct member positioned at a rear portion of said stove casing remote from said burner well and a second duct member having an opening located adjacent said burner in said well and another opening communicating into said first duct member, said first duct member comprising an enclosed duct casing oriented vertically and having walls defining a hollow interior, an inlet communicating with said second duct member for receiving high heat exhaust at a lower portion of said duct casing, an outlet for reduced-temperature exhaust at an upper portion thereof, a plurality of generally horizontal baffles forming a labyrinthine channel through the interior of said first duct member between said inlet and said outlet, and means for generating a draft of ambient air into said labyrinthine channel for mixing with the high heat exhaust received through said inlet and reducing its temperature such that a reduced-temperature exhaust is output at said outlet of said first duct member.

In preferred embodiments of the invention, the burner well is adapted to support a wok or other rounded-bottom cooking vessel on its upper annular rim, and a large burner is recessed in the well to provide a high-heat flame to the bottom of the wok. The well is lined with refractory material to insulate the heat in the well. The duct casing is a quadrangularly shaped member supported upright in the vertical direction on the rear portion of the stove casing. The baffles in the duct casing are spaced vertically from each other and have offset horizontal lengths which are alternated in opposite directions to form the labyrinthine channel. The duct casing has a double wall construction lined with insulative material to insulate the heat of the exhaust in the duct casing. The ambient air draft is provided by a second inlet in the bottom portion of the casing that is supplied by other openings formed in the stove casing.

Other objects, features and advantages of the present invention will be apparent from the following detailed description of the preferred embodiments with reference to the drawings, of which:

DETAILED DESCRIPTION OF THE INVENTION

In the following description, two general principles of the invention are illustrated by reference to a particular embodiment of a stove suitable for large-burner cooking generating a high heat exhaust. The first principle encompasses the arrangement of recessing a large burner in a well in the interior of a stove casing, so that the flame of the burner is substantially confined in the well, and directing the high heat exhaust from around the recessed burner through one duct member in the interior of the stove casing to another duct member located at a rear portion of the stove casing. The second principle encompasses the arrangement of a duct casing at the rear portion of the stove having a lower inlet for high heat exhaust from the large burner received from the duct member through the interior of the stove casing, an upper outlet, a labyrinthine channel between the inlet and outlet formed by a plurality of baffles in the duct casing, and a cool air draft for mixing with and cooling down the high heat exhaust in the channel.

The preferred embodiment of the stove is a unit sized for home cooking and has one large burner which is used for wok cooking and two smaller conventional burners. However, it is to be understood that the principles of the invention are equally applicable to multiple large-burner arrangements, as well as to industrial stoves for use in restaurants and institutional cooking.

Figure 1:
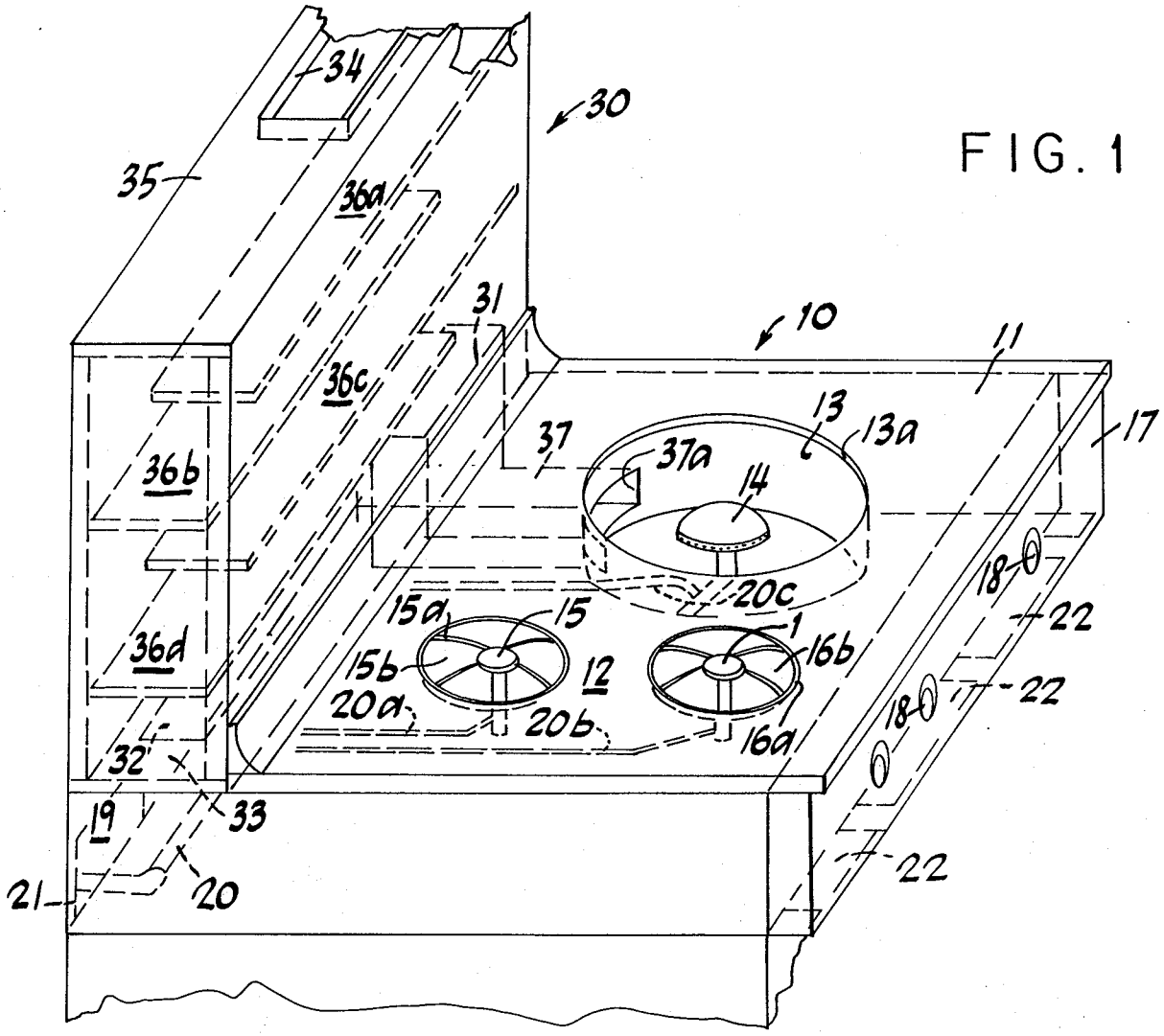
FIG. 1 is a perspective view of one embodiment of a stove suitable for large-burner cooking generating high heat exhaust, in accordance with the invention, having one large burner recessed in a well and two conventional small stove-top burners.
Figure 2:
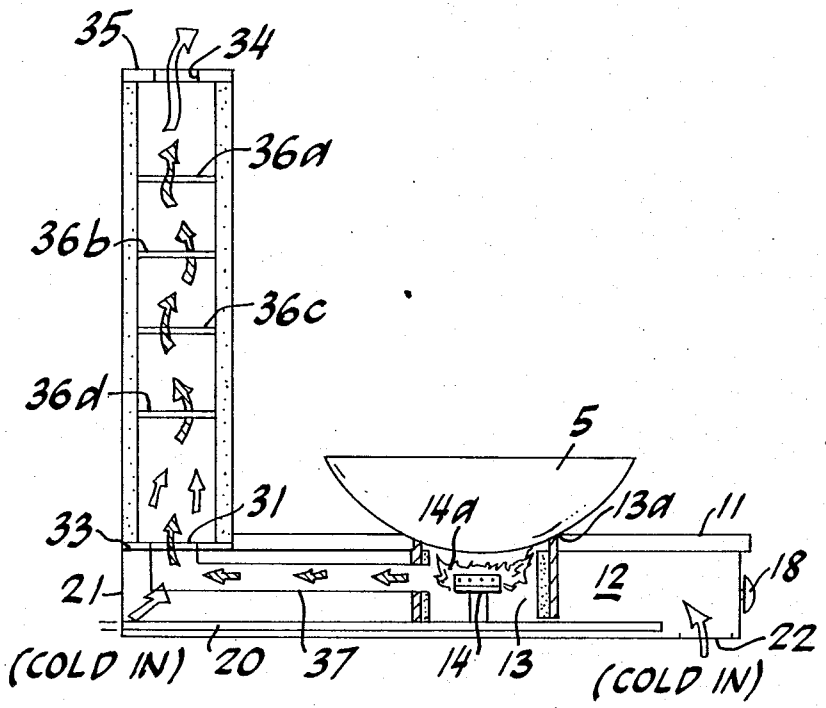
FIG. 2 is a side sectional view of the stove of FIG. 1 showing a section through the large burner, burner well, and rear duct casing.

Referring to FIG. 1, a stove embodiment in accordance with the invention has a stove casing 10 having sheet metal walls defining a horizontal upper surface 11 used as a cooking surface a hollow interior 12, and a well 13 for a large burner 14 extending into the interior of the casing 10. The well 13 has an upper annular rim 13*a* which is used to support a cooking vessel placed thereon. As illustrated in FIG. 2, the cooking vessel is preferably a wok 15 which has a rounded-bottom that rests upon the annular rim 13*a* so as to substantial close off the well 13 and prevent the flame 14*a* of the burner 14 from being exposed at the cooking surface 11. Confining the flame 14*a* in the well 13 greatly reduces the amount of heat lost to the outside, so that the heat is instead applied to the bottom of the cooking vessel. The cooking vessel may also be one having a flat bottom which is supported on the annular rim 13*a*. The stove also includes two small burners 15, 16 which may be of the conventional type positioned at the cooking surface 11 under a rigid grate 15*a*, 16*a* and above a shallow catch plate 15*b*, 16*b*.

The well 13 is preferably lined with a refractory material such as fire brick. For example, KS-4 firebrick, rated for 2500 degrees, supplied by A. P. Green, Industries, Mo., may be used. The duct member 37 may be formed from sheet metal, and the inlet 37*a* may also be lined with refractory material.

The stove casing 10 includes a front panel 17, on which gas controls 18 for the burners are arranged, and a rear portion 19 which houses a gas feed pipe 20 having individual feeds 20*a*, 20*b*, 20*c* to the burners and a connector extending through a rear opening 21 in the stove casing 10 to allow connection to a gas utility source external to the stove. The gas controls 18 on the front panel 17 are connected to control valves to the burners 14, 15, 16 by mechanical linkages which are well known and therefore not shown in the drawings or described further herein.

Above the rear portion 19 of the stove casing 10, a duct casing 30 is arranged vertically upright and has a quadrangular form. The duct casing has a hot exhaust inlet 31 and a cool air inlet 32 formed in a lower panel 33, a warm air outlet 34 formed in an upper panel 35, and a plurality of baffles 36*a*, 36*b*, 36*c*, 36*d* forming a labyrinthine channel 36 from the inlets 31, 32 to the outlet 34. The cool air inlet 32 communicates with the interior 12 of the stove casing 10 and is supplied with cool air through rear opening 21 and front openings 22 formed at a lower side of the front panel 17. The hot air inlet 31 communicates with an opening in a duct member 37 which has its other opening communicating into the well 13 at a position adjacent the large burner 14.

Figure 3:
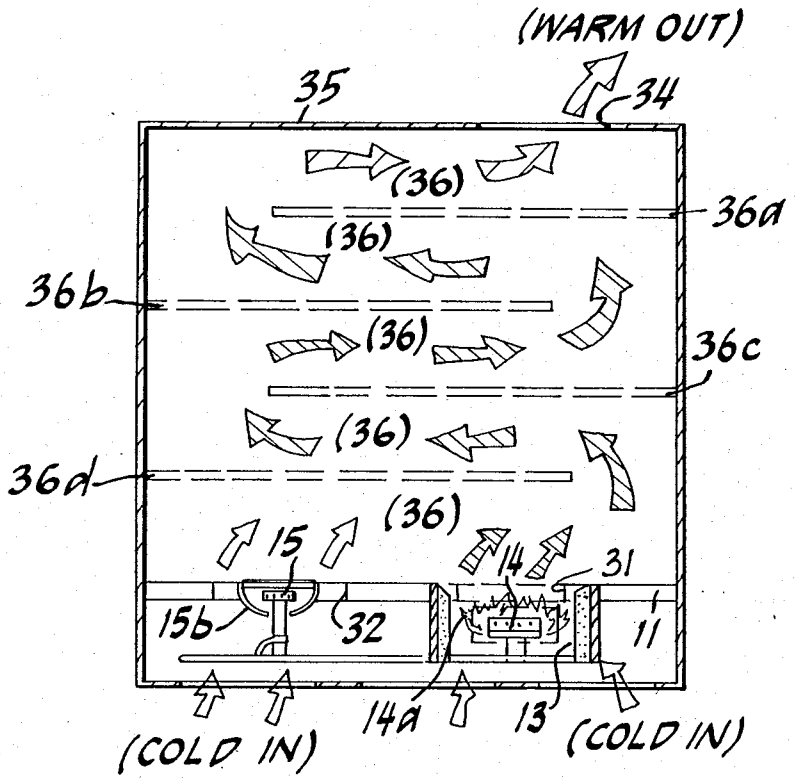
FIG. 3 is a front section view of the stove of FIG. 1 showing a section through the large burner and one of the small burners.

The operation of the stove is illustrated in FIGS. 1–3. The hot exhaust air heated by the flame 14*a* of the large burner 14 is trapped in the well 13 and becomes entrained by a convection draft of cold air entering the stove casing through openings 20, 22, and directed along the duct member 37 to the hot air inlet 31 of the duct casing 30. Cold air also enters the duct casing 30 through the cold air inlet 32. The hot and cold air are combined in the streams moving by convection along the labyrinthine channel 36 formed by the baffles 36*a*, 36*b*, 36*c*, 36*d*. The baffles have lengths shorter than the horizontal width of the duct casing 30, and are arranged alternatingly offset in opposite directions in ascending vertical order. The cold air is indicated by arrows that are white, hot air by arrows that are densely cross-hatched, and warm air by arrows that are sparsely cross-hatched.

As the hot and cold air streams move along the channel 36, they become mixed together, and the resulting temperature of the combined air streams is substantially reduced. For example, hot exhaust air of 500 to 600 degrees Fahrenheit in the vicinity of the burner becomes cooled down to about 80 to 100 degrees Fahrenheit at the outlet 34 in ambient air of about 70 degrees. The exiting air at the outlet 34 is thus cooled down enough so that it can be exhausted into the ambient air or handled by a small kitchen fan and vent. The stove thus provides the advantages of large-burner cooking suitable for use in the home. The positioning of the recessed burner 14 in the well 13, so that the flame 14*a* is not exposed to the outside, also ensures that the ambient air around the cooking surface will remain cool and comfortable without the necessity for forced-draft air handling equipment. The design of the stove also allows the air entrainment and mixing to be accomplished by natural convection, thereby eliminating any need for movement of air by forced draft. However, a small fan may be used to increase the volume of air movement if desired.

Figure 4:
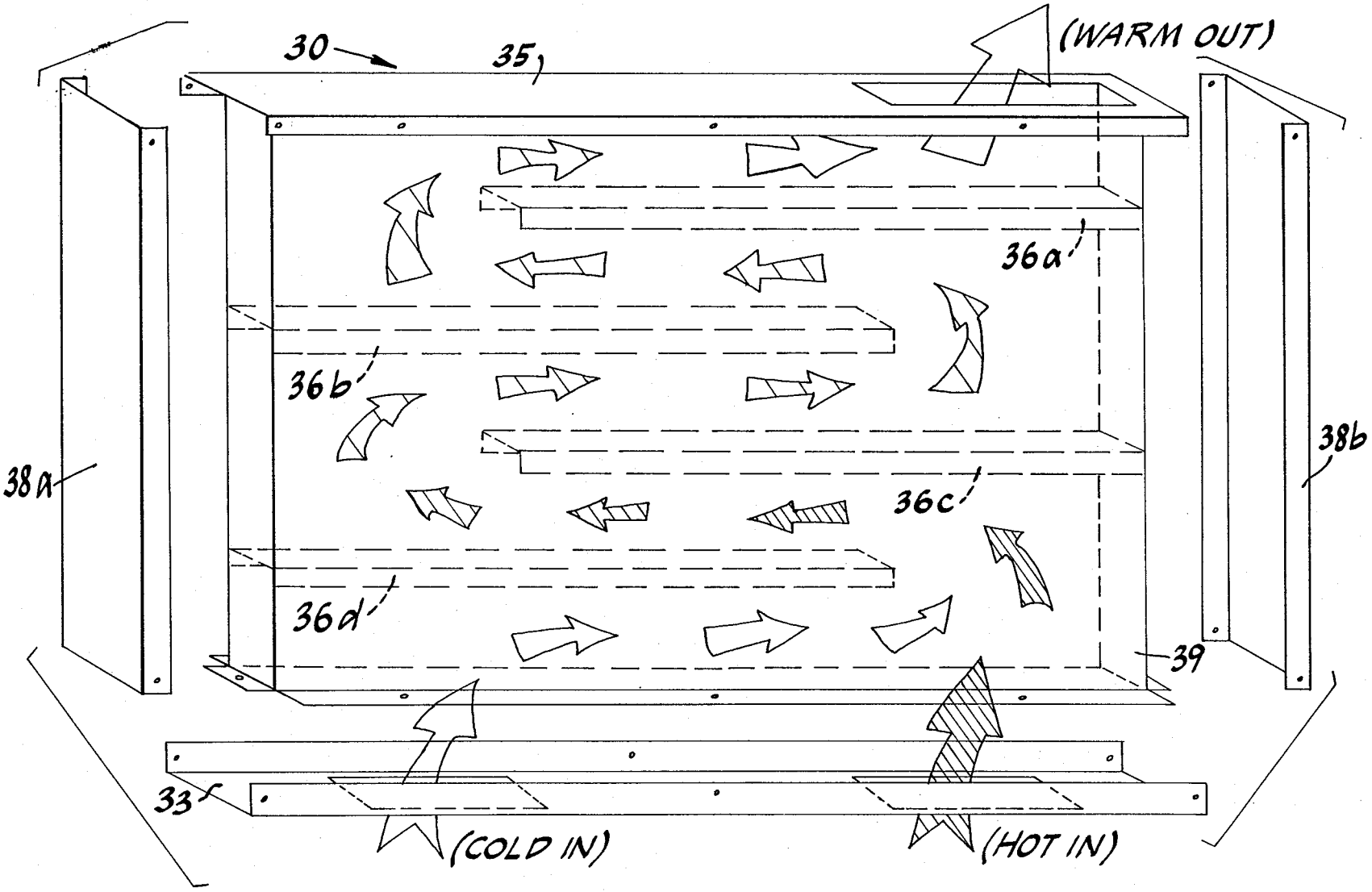
FIG. 4 is an exploded diagram illustrating the double wall construction of the duct casing.

In FIG. 4, the duct casing 30 is shown formed with a double wall construction of outer panels 33, 35, 38*a*, 38*b*, (facing and back panels not shown for simplicity) and an inner casing 39. The panels and casing may all be formed of sheet metal, preferably stainless steel. The hollow space between the outer panels and inner casing is filled with an insulative material to insulate the outer panels from the heat of the air streams moving through the inner casing. For example, Inswool TM -HP ceramic fiber blanket, made by A. P. Green Industries, Mo., may be used. As a result the outer panels remain cool to the touch, thus enhancing its safety.

The stove casing and duct casing may be formed as an integral unit, or as separate modules that can be mounted together for installation. The assembled unit is a stove-top range unit that can be mounted on a conventional oven to form a combined oven/range unit. Alternatively, it may be sold as a range unit which can be installed over a storage cabinet.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. A stove suitable for large-burner cooking generating a high heat exhaust comprising:

an enclosed stove casing having walls defining a horizontal upper surface used as a cooking surface and a hollow interior;

a burner well extending into the interior of said stove casing and having an upper annular rim at said horizontal upper surface, said annular rim defining a support on which a cooking vessel is placed for cooking and being dimensioned such that the cooking vessel substantially closes off said well from exposure at said horizontal upper surface;

a burner recessed at an interior position in said well in the interior of said casing which provides a flame to a bottom portion of the cooking vessel; and ducting means including a first duct member positioned at a rear portion of said stove casing remote from said burner well and a second duct member having an opening located adjacent said interior position of said well and another opening communicating into said first duct member for conveying high heat exhaust from said burner into said first duct member at said rear portion of said stove casing, wherein said burner well has vertically oriented cylindrical walls circumferentially surrounding said burner which are lined with a refractory material to insulate the stove casing from the heat from said burner in said well, and wherein said second duct member extends through said cylindrical walls and liner material and communicates into said burner well with its second opening positioned adjacent said burner.

2. A stove according to claim 1, wherein said annular rim of said burner well is dimensioned to support a wok or other rounded-bottom cooking vessel, and a large burner is recessed in said well to provide a high-heat flame to the bottom of said vessel.

3. A stove according to claim 1, wherein said first duct member comprises an enclosed duct casing oriented vertically and having walls defining a hollow interior, an inlet communicating with said second duct member for receiving high heat exhaust at a lower portion of said duct casing, an outlet for reduced-temperature exhaust at an upper portion thereof, a plurality of generally horizontal baffles forming a labyrinthine channel through the interior of said first duct member between said inlet and said outlet, and means for generating a draft of ambient air into said labyrinthine channel for mixing with said high heat exhaust and reducing its temperature such that a reduced-temperature exhaust is output at said outlet of said first duct member.

4. A stove according to claim 3, wherein said duct casing is a quadrangularly shaped member supported upright on the rear portion of said stove casing.

5. A stove according to claim 3, wherein said baffles in the duct casing are spaced vertically from each other and have offset horizontal lengths which are alternated in opposite directions to form said labyrinthine channel.

6. A stove according to claim 3, wherein said duct casing has a double wall construction lined with insulative material to insulate the stove from the heat of the exhaust in the duct casing.

7. A stove according to claim 3, wherein said ambient air draft is generated by a second inlet in the bottom portion of said stove casing which is supplied with ambient air through openings formed in said stove casing.

8. A stove suitable for large-burner cooking generating a high heat exhaust comprising:

an enclosed stove casing having walls defining a horizontal upper surface used as a cooking surface and a hollow interior;

a burner well extending into the interior of said stove casing below an opening in the cooking surface over which a cooking vessel is placed;

a burner in said well which provides a flame to a bottom portion of the cooking vessel; and ducting means including a first duct member positioned at a rear portion of said stove casing remote from said burner well and a second duct member having an opening located adjacent said burner in said well and another opening communicating into said first duct member, said first duct member comprising an enclosed duct casing oriented vertically and having walls defining a hollow interior, an inlet communicating with said second duct member for receiving high heat exhaust at a lower portion of said duct casing, an outlet for reduced-temperature exhaust at an upper portion thereof, a plurality of generally horizontal baffles forming a labyrinthine channel through the interior of said first duct member between said inlet and said outlet, and means for generating a draft of ambient air into said labyrinthine channel for mixing with said high heat exhaust and reducing its temperature such that a reduced-temperature exhaust is output at said outlet of said first duct member.

9. A stove according to claim 8, wherein said duct casing is a quadrangularly shaped member supported upright on the rear portion of said stove casing.

10. A stove according to claim 8, wherein said baffles in the duct casing are spaced vertically from each other and have offset horizontal lengths which are alternated in opposite directions to form said labyrinthine channel.

11. A stove according to claim 8, wherein said duct casing has a double wall construction lined with insulative material to insulate the stove from the heat of the exhaust in the duct casing.

12. A stove according to claim 8, wherein said ambient air draft is generated by a second inlet in the bottom portion of said stove casing which is supplied with ambient air through openings formed in said stove casing.

13. A stove according to claim 8, wherein said burner well extends into the interior of said stove casing and has an upper annular rim at said horizontal upper surface, said annular rim defining a support on which a cooking vessel is placed for cooking and being dimensioned such that the cooking vessel substantially closes off said well from exposure at said horizontal upper surface.

14. A stove according to claim 13, wherein said burner well has vertically oriented cylindrical walls which are lined with a refractory material to insulate the stove from the heat from said burner in said well.

15. A stove according to claim 14, wherein the opening of said second duct member in said burner well is formed through said cylindrical walls and liner material.

16. A stove according to claim 8, wherein said duct casing and said stove casing are formed as separate modules that are assembled together for installation.

17. A stove according to claim 8, wherein said duct casing and stove casing are installed as a stove top unit over a lower oven or storage unit.

18. A duct system for converting a high heat exhaust from a heat source into a reduced-temperature exhaust comprising:

an enclosed duct casing extending in horizontal and vertical directions and having walls defining a hollow quadrangularly-shaped interior, a first inlet for receiving high heat exhaust from the heat source at a lower portion of said duct casing, a second inlet for receiving a flow of ambient air at a lower portion of said duct casing, an outlet for reduced-temperature exhaust at an upper portion of said duct casing, a plurality of generally horizontal baffles offset in alternate horizontal directions forming a labyrinthine channel through the interior of said duct casing winding around said horizontal baffles upwardly in the vertical direction from said first and second inlets to said outlet, and means including said first and second inlets for generating a draft of ambient air into said labyrinthine channel for mixing with said high heat exhaust and reducing its temperature such that a reduced-temperature exhaust is output at said outlet of said duct casing, wherein said first and second inlets are formed through a bottom horizontal wall of said lower portion of said duct casing, and said first and second inlets are spaced apart in the horizontal direction from each other with said first inlet being located in a downstream direction of said second inlet such that convection of the high heat exhaust received through said first inlet and rising through said labyrinthine channel toward said outlet creates a draft which draws in ambient air through said second inlet.

* * * * *